US007059254B2

(12) United States Patent
Strong et al.

(10) Patent No.: US 7,059,254 B2
(45) **Date of Patent: *Jun. 13, 2006**

(54) PERSONAL TABLE

(75) Inventors: L. Curtis Strong, Clearfield, UT (US); S. Curtis Nye, Clinton, UT (US); Thayne B. Haney, Syracuse, UT (US); Brandon Smith, Ogden, UT (US)

(73) Assignee: Lifetime Products, Inc., Clearfield, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/692,892

(22) Filed: Oct. 24, 2003

(65) Prior Publication Data

US 2004/0182290 A1 Sep. 23, 2004

Related U.S. Application Data

(60) Provisional application No. 60/421,221, filed on Oct. 25, 2002, now Pat. No. 6,912,961.

(51) Int. Cl.
*A47B 3/02* (2006.01)

(52) U.S. Cl. ..... 108/118; 108/161

(58) Field of Classification Search ..... 108/115, 108/116, 118, 119, 120, 132, 141; 248/423, 248/157, 164, 439, 188, 188.1, 188.2, 188.6
See application file for complete search history.

(56) References Cited

U.S. PATENT DOCUMENTS

| | | | |
|---|---|---|---|
| 544,603 | A | 8/1895 | Thompson |
| 2,675,286 | A | 4/1954 | Derman |
| 2,692,807 | A | 10/1954 | Cordola |
| D175,939 | S | 11/1955 | Gettelman et al. |
| 2,857,228 | A | 10/1958 | Koett |
| 2,879,118 | A | 3/1959 | Kolb |

(Continued)

FOREIGN PATENT DOCUMENTS

GB 2216073 A * 10/1989

OTHER PUBLICATIONS

Declaration of Maxine Lesht in Support of GSC's Response to Lifetime's Motion for Temporary Restraining Order and Preliminary Injunction of the GSC "Enduro2" Personal Table, 18 pages (including Exhibits 1-2), Oct. 5, 2003. *Lifetime Products* v. *GSC Technology Corporation*, Case No. 1:03CV00062TC (N.D. Utah).

(Continued)

*Primary Examiner*—Jose V. Chen
(74) *Attorney, Agent, or Firm*—Workman Nydegger

(57) ABSTRACT

A personal table including a table top supported by a support assembly is disclosed. The table top is preferably constructed from blow-molded plastic and the support assembly preferably includes a first leg and a second leg that are pivotally connected. The legs desirably have a generally X-shaped configuration when the legs are placed in an upright position and the legs can be collapsed into a storage position. Each of the legs may include a lower portion, a body portion and an upper portion that is preferably selectively connected to the table top. The legs, for example, can be connected to the table top by inserting the upper portions of the legs into leg receiving recess. Desirably, the table top includes a plurality of leg receiving recesses and the legs can be selectively attached to the leg receiving recesses in order to vary the height of the table.

39 Claims, 11 Drawing Sheets

U.S. PATENT DOCUMENTS

| | | | |
|---|---|---|---|
| 2,912,775 | A | 11/1959 | Gettelman |
| 3,031,243 | A | 4/1962 | Crenoi |
| 3,094,948 | A | 6/1963 | Clow |
| 3,108,550 | A | 10/1963 | Knoblock |
| 3,224,389 | A | 12/1965 | Kent |
| 3,247,811 | A | 4/1966 | Bauder |
| 3,405,587 | A | 10/1968 | Meazzi et al. |
| 3,685,824 | A | 8/1972 | Quinn |
| 3,906,848 | A | 9/1975 | Gow |
| 3,954,068 | A | 5/1976 | Roberts et al. |
| 4,099,469 | A | 7/1978 | Sahli |
| 4,105,271 | A | 8/1978 | Sebel et al. |
| 4,168,669 | A | 9/1979 | Arnoff |
| 4,196,675 | A | 4/1980 | Cook |
| 4,248,161 | A | 2/1981 | Adair et al. |
| 4,433,869 | A | 2/1984 | Payne, Jr. et al. |
| 4,944,235 | A | 7/1990 | Jahnke et al. |
| 4,951,576 | A | 8/1990 | Cobos et al. |
| 5,086,711 | A | 2/1992 | Matthews |
| 5,272,825 | A | 12/1993 | Simpson |
| 5,353,715 | A | 10/1994 | Luyk |
| 5,358,204 | A | 10/1994 | Terada |
| D353,286 | S | 12/1994 | Hand |
| D355,091 | S | 2/1995 | Green et al. |
| 5,394,808 | A | 3/1995 | Dutro et al. |
| D358,954 | S | 6/1995 | Leduc |
| 5,465,673 | A | 11/1995 | Ma |
| 5,483,901 | A | 1/1996 | Tisbo et al. |
| D366,781 | S | 2/1996 | Cartwright |
| 5,509,360 | A | 4/1996 | Chiu |
| 5,603,267 | A | 2/1997 | Soper |
| 5,644,994 | A | 7/1997 | Liang et al. |
| 5,848,822 | A | 12/1998 | Wu |
| D412,831 | S | 8/1999 | Murakami |
| D416,148 | S | 11/1999 | Pagnon et al. |
| 6,019,050 | A | 2/2000 | Ranta |
| 6,112,674 | A | 9/2000 | Stanford |
| 6,327,800 | B1 | 12/2001 | Daams |
| D452,626 | S | 1/2002 | Petri |
| D452,787 | S | 1/2002 | Petri |
| 6,401,630 | B1 | 6/2002 | Peterson |
| D468,135 | S | 1/2003 | Ashby et al. |
| D469,994 | S | 2/2003 | Smith |
| D469,996 | S | 2/2003 | Ashby |
| D470,352 | S | 2/2003 | Strong |
| 6,530,331 | B1 | 3/2003 | Stanford |
| 6,550,404 | B1 | 4/2003 | Stanford |
| D481,567 | S | 11/2003 | Ashby et al. |
| 2002/0152934 | A1 | 10/2002 | Haney |

OTHER PUBLICATIONS

Blow Mold Products/Outdoor Products, Dongguan Shichang Metals Factory Co., Ltd., 4 pages, Date Unknown (copyright notice includes the years 2002-2003).

Mosaic, profile edge in center, Gunlock Co. © 2003, p. 3.

* cited by examiner

PERSONAL TABLE

CROSS-REFERENCE TO RELATED APPLICATIONS

This application claims priority to and the benefit of U.S. provisional patent application Ser. No. 60/421,221, filed Oct. 25, 2002, now U.S. Pat. No. 6,912,961 entitled PERSONAL TABLE. This application is a continuation-in-part of U.S. patent application Ser. No. 10/340,018, filed Jan. 9, 2003, entitled PERSONAL TABLE. This application is also a continuation-in-part of U.S. design patent application Ser. No. 29/176,792, filed Feb. 26, 2003, entitled PORTION OF A TABLE TOP, now U.S. Pat. No. D485,100; a continuation-in-part of U.S. design patent application Ser. No. 29/176,842, filed Feb. 26, 2003, entitled TABLE TOP, now U.S. Pat. No. 6,912,961 TOP, now U.S. Pat. No. D485,719; and a continuation-in-part of U.S. design patent application Ser. No. 29/176,841, filed Feb. 26, 2003, entitled SUPPORT FOR A TABLE TOP, now U.S. Pat. No. D481,567. Each of these applications and patents are expressly incorporated by reference in their entireties.

BACKGROUND OF THE INVENTION

1. Field of the Invention

The present invention generally relates to tables and, in particular, to a light-weight table that may be adjustable in height and may have legs that can be moved between a extended or use position and a collapsed or storage position.

2. Description of Related Art

Conventional tables are used for a variety of purposes and come in a wide array of designs. In some situations, it is desirable to have a smaller table for personal or individual use. For example, persons living in a small space, such as a studio apartment, may choose to use a smaller personal-sized table on which to dine or perform other tasks. Other persons may use a personal table to place beside a chair for the convenience of holding objects while reading, watching television or listening to the radio. Still others may use personal tables to perform tasks such as writing, working, or using a computer.

Conventional tables often include table tops constructed from wood, particle board or metal. Table tops constructed from wood, particle board or metal, however, are often relatively heavy and this may make the table awkward or difficult to move. Conventional table tops constructed from wood or metal are also relatively expensive and the table tops must generally be treated or finished before use. For example, table tops constructed from wood must generally be sanded and painted, and metal table tops must be formed into the desired shape and painted. In addition, these relatively heavy table tops increase the cost of transportation, shipping, and storage of the tables.

In order to decrease the weight of conventional tables, table tops can be constructed from relatively thin, light-weight materials. Disadvantageously, these light-weight table tops frequently require reinforcing members or other structural parts such as brackets, support members and the like to strengthen the table top. These additional parts may increase the strength of the table top, but these additional parts also increase the weight of the table. In addition, these additional parts increase manufacturing costs and require additional time to assemble the table. Furthermore, these additional parts may have sharp edges that can injure the user's arms or legs.

Known tables may also allow the height of the table to be adjusted to suit the needs of a particular user. For example, the length of the table legs may be increased or decreased by a telescoping assembly. Disadvantageously, because the telescoping assemblies include overlapping components, the assembly is relatively heavy. Additionally, conventional tables may use other mechanisms to allow the height of the table to be adjusted, but these devices are often relatively complex and require additional parts, which generally increases the amount of time required to manufacture the table and the costs to assemble the table. These complex designs may also result in tables that are relatively difficult for the consumer to use and these tables may require a substantial amount of time in order for the height of the table to be adjusted.

Another type of known table is a traditional card table in which each leg is pivotally connected to the table top by a brace and each leg individually folds against the table top. It is known to attempt to reduce the inconvenience of individually folding each of the legs against the table top by coupling two of the legs together by a long connecting rod. This may increase the stability of the table top and enable the user to simultaneously fold two legs into the collapsed position. The long connecting rods, however, may increase the cost of the table, reduce space under the table top, and the rods often easily break or become disconnected.

Conventional tables may also detachably connect the legs to the table top to allow the user to more easily collapse, move and store the table. Disadvantageously, the detachable legs often create a table that is not sturdy or stable. Additionally, moving a table with this type of attachment when the legs are still attached is often difficult because the legs may undesirably detach. These known types of table may include an attachment that mechanically secures the leg to the table top. These mechanical attachments, such as plastic or metal clips or brackets, often break or are otherwise damaged. Further, attachment of these devices to the table top may structurally weaken the table top, which may allow the table to unexpectedly fail. Further, attaching multiple separate attachment mechanisms to the table top by fasteners such as screws or bolts may undesirably weaken the table top.

Many conventional tables include four legs in order to support the table top above a surface such as the floor. The four separate legs, however, increase the weight of the table. In additional, the four legs require four separate attachment mechanisms to attach the legs to the table top, which increases the cost and complexity of the table. The four separate attachment mechanisms may also undesirably increase the weight of the table and require multiple mechanical fasteners such as screws and bolts to connect the attachment mechanisms to the table top.

SUMMARY OF THE INVENTION

A need exists for a table that eliminates the problems and other deficiencies found in convention tables.

One aspect of the present invention is a relatively small-sized table that is designed for use by a single person. This type of table that is intended for use by an individual is referred to as a personal table, but it will be appreciated that more than one person could use the table if desired. Advantageously, the personal table is relatively small and light-weight, which makes the table easy to move and transport. Significantly, because the table is sized and configured for personal use, it does not take up unnecessary space or provide a large amount of unused space. Therefore, the personal table provides ample space for a single user without requiring a large area or wasting unnecessary space.

Another aspect is a table that can be used for a wide variety of different situations and uses such as a table for supporting a television, computer, sewing machine, microwave, lamp, luggage, and the like. The table can also be used for a wide variety of other uses such as a bedside table, coffee table, night stand, desk, shop table, and the like. Further, the table can be used while performing a wide variety of tasks such as reading, writing, studying, working, etc. Thus, the personal table can be used in a number of different environments and it can perform numerous different tasks.

Still another aspect is a table that is suitable for use in a variety of situations and environments because it preferably provides ample space for a user, while at the same time being lightweight so as to enable the table to be moved from place to place with relative ease. Advantageously, the table can have different sizes and configurations depending upon the desired use of the table. The table may also have a larger size so that it can be used by more than one person at a time.

A further aspect is a table with a table top that is preferably constructed from a lightweight material so that the table is easily portable and can be readily lifted and moved by a single person. Desirably, the table top is constructed from blow-molded plastic, such as high density polyethylene. The blow-molded table top provides a rigid, high-strength structure that is capable of withstanding repeated use and wear. Advantageously, the blow-molded table top can be easily manufactured and formed into the desired size and shape.

Yet another aspect is a table in which the height of the table can be readily adjusted. Advantageously, the adjustable height table allows it to be used for many different purposes. For example, the height of the table may be adjusted to allow the table to be used as a desk, televisions stand, bedside table or end table.

A still further aspect is a table with a table top that is support by a single pair of legs. The legs are preferably pivotally connected and the legs preferably allow the height of the table top to be easily adjusted. Significantly, because the table top is support by a single pair of legs, that provides additional leg room and/or storage room under the table. In addition, the single pair of legs is light-weight and easily attached to the table top. The single pair of legs can desirably support the table top and any suitable objects placed on the table. Advantageously, because the personal table has a relatively small size, the single pair of legs can properly support the table.

Another aspect is a table with a table top that is supported by a single pair of legs and the legs are preferably pivotally connected by a pin, bolt or screw into a generally X-shaped configuration. The pivotal connection advantageously allows the legs to be quickly moved between the storage and use positions. The pivotal connection also allows the height of the table to be readily adjusted. Desirably, each leg includes a lower portion that contacts a support surface such as the floor, an elongated body portion, and an upper portion that is sized and configured to be connected to the table top. The elongated body portion of each of the legs may include two or more support members, which helps prevent twisting or undesirable torque on the connection of the upper and lower portions to the elongated body portion.

Yet another aspect is a table in which the legs are attached to the underside of the table top and the legs are preferably offset from the center of the table. In particular, the legs are preferably positioned near an outer edge of the table top to provide enhanced legroom for the user. This also allows the table top to be positioned closer to the body of the user when the table, for example, is being used as a desk or for a writing surface. Advantageously, this may make the table more convenient for the user. In addition, the lower portion of the legs may form elongated feet that are used to create a stable base for the table top.

A still further aspect is a table with legs that are movable between a use position and a storage position. The legs preferably extend outwardly from the table top in the use position and the legs support the table top above a surface such as the floor. In the storage position, the legs are preferably collapsed into a relatively compact area, which allows the table to be easily transported or stored. The legs, for example, may be placed adjacent and/or proximate to the bottom surface of the table top in the collapsed position. Advantageously, the collapsed legs may facilitate stacking of the tables and decrease the space required to store or ship the tables.

A further aspect is a table that is adjustable in height according to the needs of the user. For example, the bottom surface of the table top may include a plurality of leg receiving recesses that are sized and configured to selectively receive a portion of at least one of the legs. The leg or legs can be readily moved from one leg receiving recess to another leg receiving recess to allow the height of the table to be adjusted. In particular, the leg receiving recesses are preferably positioned into two or more generally aligned pairs of openings or receiving portions disposed on the underside of the table top. Preferably one of the pairs of generally aligned receiving portions is positioned proximate an edge of the table top and another of the pairs of generally aligned receiving portions is positioned proximate the center portion of the table top. The ends of the upper portion of the legs can then be selectively inserted and removed from the two or more generally aligned pairs of receiving portions to allow the height of the table to be adjusted. Advantageously, by inserting the upper portion of the legs into different pairs of receiving portions, the height of the table top can be readily adjusted. In addition, one or both of the legs can be detached from the table top to allow the table to be stored. Significantly, the readily adjustable legs provides increase flexibly and a variety of uses for the personal table. For example, the table can be positioned at a desired height for eating, watching television, or supporting items next to a chair. The table can also be quickly and easily folded into a storage position.

Yet another aspect is a personal table with legs that can be attached to receiving portions formed in the table top. In particular, the legs receiving portions may include generally aligned pairs of leg receiving recesses and the ends of the upper portions of the legs may be inserted into the generally aligned pairs of leg receiving recesses. Desirably, the length of the upper portion of one or both of the legs is adjustable to allow the upper portion of the leg to be inserted and removed from the generally aligned pairs of leg receiving recesses.

A further aspect is a table with a frame and the frame preferably includes two generally parallel side rails. Each of the side rails preferably includes at least two pairs of generally aligned openings or apertures. The leg or legs can be readily moved from one pair of generally aligned openings to another pair of generally aligned openings to allow the height of the table to be adjusted. Preferably one of the pairs of generally aligned openings is positioned proximate an edge of the table top and another of the pairs of generally aligned openings is positioned proximate the center portion of the table top. The ends of the upper portion of the legs can then be selectively inserted and removed from the two or more generally aligned pairs of openings to allow the height of the table to be adjusted. Advantageously, the openings in the frame can be used in conjunction with leg receiving recesses, if desired.

Another aspect is a table in which one or both legs may be selectively detached from the table top to allow the legs to be moved from an extended to a collapsed position. In addition, the selective detachment of one or both of the legs may allow the height of the table to be easily adjusted by attaching the legs to different leg receiving recesses. One of the legs may also be permanently attached to the table top.

A still further aspect is a table that can have a variety of suitable sizes and configurations. In addition, the table can be manufactured to have one of several combinations of adjustable height settings. Thus, the table can be optimized for a specific use, or the table can be easily adjustable for a variety of different uses.

Advantageously, the table is relatively simple to manufacture because it preferably consists of a table top constructed from blow-molded plastic and a pair of pivotally interconnected legs. The blow-molded table top includes two opposing walls that are spaced apart, which increase the strength and rigidity of the table top. The blow-molded table top may also include one or more depressions or tack-offs to further increase the strength of the table top and/or interconnect the spaced apart walls. Significantly, the blow-molded table top is light-weight, durable, generally weather resistant and temperature insensitive, and it does not corrode, rust or otherwise deteriorate. The blow-molded table top can also be formed in various shapes, sizes, configurations and designs.

Additionally, the table is easy to assemble, which reduces manufacturing and labor costs. Further, the consumer can easily assemble the personal table and the consumer will appreciate many of the aspects of the personal table such as the light-weight, easy height adjustment, portability, sturdiness, and wide variety of uses in any different environments.

These and other aspects, features, and advantages of the present invention will become more apparent from the following detailed description of preferred embodiments and appended claims.

BRIEF DESCRIPTION OF THE DRAWINGS

The appended drawings contain figures of preferred embodiments of the personal table. The above-mentioned aspects, features and advantages of the personal table, as well as other aspects, features and advantages, will be described in connection with the preferred embodiments. It is appreciated that these drawings depict only certain preferred embodiments of the invention and are therefore not to be considered limiting of its scope. The invention will be described and explained with additional specificity and detail through the use of the accompanying drawings in which.

DETAILED DESCRIPTION OF PREFERRED EMBODIMENTS

The present invention is directed towards a table and, in particular, to a table that is intended to be used by a single user at one time. The principles of the present invention, however, are not limited to a table intended for use by an individual user. It will be understood that, in light of the present disclosure, the table can be used by more than one user at any given time.

Additionally, to assist in the description of the table, words such as top, bottom, front, rear, right and left are used to describe the accompanying figures. It will be appreciated, however, that the table can be located in a variety of desired positions—including various angles, sideways and even upside down. A detailed description of the table now follows.

Figure 1:
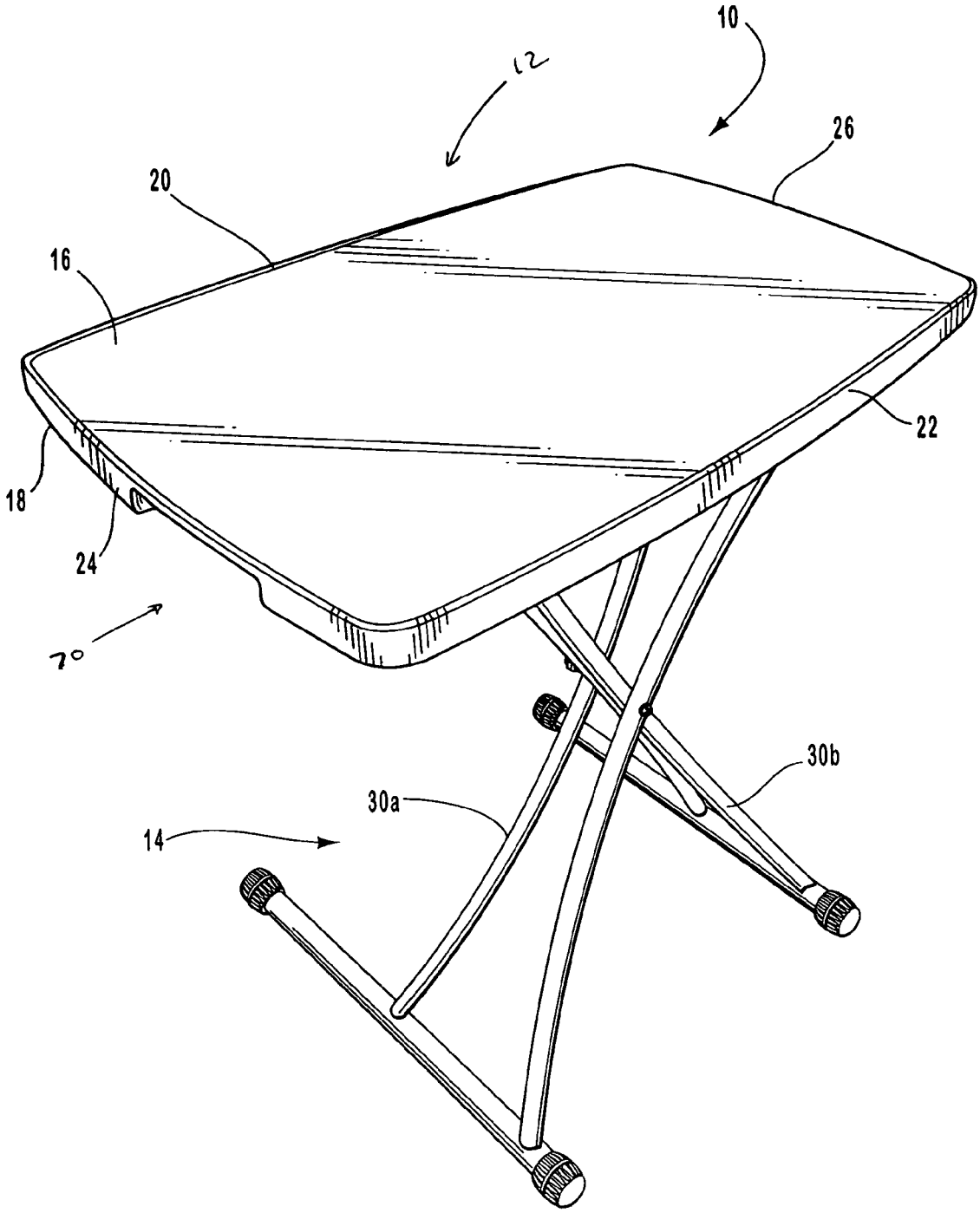
FIG. 1 is a rear perspective view of a personal table in accordance with an embodiment of the present invention.

As seen in FIG. 1, an exemplary table 10 is shown. The table 10 is preferably a relatively small-sized table that is intended for use by a single person at one time. Advantageously, because the table 10 is sized and configured for personal use, it does not require a large amount of space. Therefore, the table 10 provides ample space for a single user without requiring a large area or unnecessary space. This table 10 that is sized and configured for use by a single person is referred to as a personal table.

The personal table 10 includes a table top 12 and a support assembly 14 that is used to support the table top above a surface such as the floor or ground. The table top 12 includes a top 16, bottom 18, front 20, rear 22, right side 24 and left side 26. The table top 12 may also include a beveled, sloped or rounded surface disposed between the top surface 16 and one or more of the sides 20, 22, 24 and 26. The beveled surface may be sized and configured to increase the comfort and safety of the user. The beveled surface, for example, may be larger along the front 20 of the table top 12, but it will be appreciated that the table 10 does not require a beveled surface.

As shown in FIG. 1, the table top 12 preferably has a generally rectangular configuration with rounded corners and slightly rounded outer edges or sides 20, 22, 24, and 26. Desirably, the table top 12 is about thirty (30) inches in length and about twenty (20) inches in width, but one skilled in the art will appreciate that the table top can have other suitable sizes and configurations. For example, the table top 12 may be larger or smaller and the table top can have other configurations such as square, circular, oval, and the like depending, for example, upon the intended use of the table 10. In addition, the corners and edges of the table top 12 do not have to rounded and, in contrast, the corners and edges could have any desirable configuration, but the rounded features may increase the comfort and/or safety of the user.

Advantageously, the table 10 can be used for a wide variety of purposes and in a number of different environments. For instance, the table 10 can be used as a television stand, computer table, sewing table, bedside table, coffee table, microwave stand, desk, shop table, luggage stand and the like. In addition, the table 10 can be used for working, reading, writing and other suitable uses. Accordingly, the table 10 is capable of many different uses and it is preferably sized and configured to be used by a single person at one time. The table 10, as discussed in more detail below, is preferably sized and configured to support one or more objects related to these different tasks and uses. For example, the table 10 is desirably configured to support a television, computer, books, or luggage according to its intended use by the individual user.

The table top 12 is preferably constructed from a lightweight material and, more preferably, the table top is constructed from plastic, such as high density polyethylene. The plastic table top 12 is desirably formed by a blow-molding process because, for example, it allows a strong, lightweight, rigid and sturdy table top to be quickly and easily manufactured. Advantageously, the blow-molded plastic table top 12 has a lighter weight that conventional table tops constructed from wood or metal, and the blow-molded plastic table top can be constructed from less plastic than conventional plastic table tops, which may save manufacturing costs and reduce consumer costs. In particular, the blow-molded table top 12 can be manufactured with thin plastic walls and that allows the table top to cool faster during the manufacturing process, which decreases the manufacturing time. Further, the blow-molded plastic table top 12 can be constructed with any suitable shape, configuration, size, design and/or color depending, for example, upon the intended use of the table 10. For example, the table top 12 can be constructed with a generally rectangular configuration of about eighteen by about twenty-four inches (18×24), a table top with a generally circular configuration with a diameter of about twenty inches (20) or a table top with a generally square configuration with twenty-four inch (24) sides may be easily formed during the blow-molding process. Of course, it will be appreciated that the blow-molded table top 12 can have any suitable size and configuration depending, for example, upon the intended use of the personal table 10.

The table top 12 is preferably constructed from blow-molded plastic because blow-molded plastic table tops are durable, weather resistant, generally temperature insensitive, corrosion resistant, rust resistant, and generally do not deteriorate over time. One skilled in the art, however, will appreciate that the table top 12 does not have to be constructed from blow-molded plastic and other suitable materials and/or processes can be used to construct the table top depending, for example, upon the intended use of the personal table 10. Thus, the table top 12 could be constructed from other materials with suitable characteristics, such as wood, metal and other types of plastic. Additionally, the table top 12 does not have to be constructed from blow-molded plastic and it could be constructed from injection molded plastic, extrusion molded plastic, and the like.

As shown in FIG. 1, the top 16 and bottom 18 surfaces of the table top 12 are spaced apart a given distance and these two spaced apart surfaces help create a rigid and strong table top 12. Additionally, the top and bottom surfaces 16, 18 may be interconnected by one or more depressions or other reinforcement structures and these structures may be sized and configured to increase the strength and/or rigidity of the table top 12. Advantageously, these depressions and/or other reinforcement structures can be integrally formed in the table top 12 as part of a one-piece structure, for example, during the blow-molding process.

Figure 3:
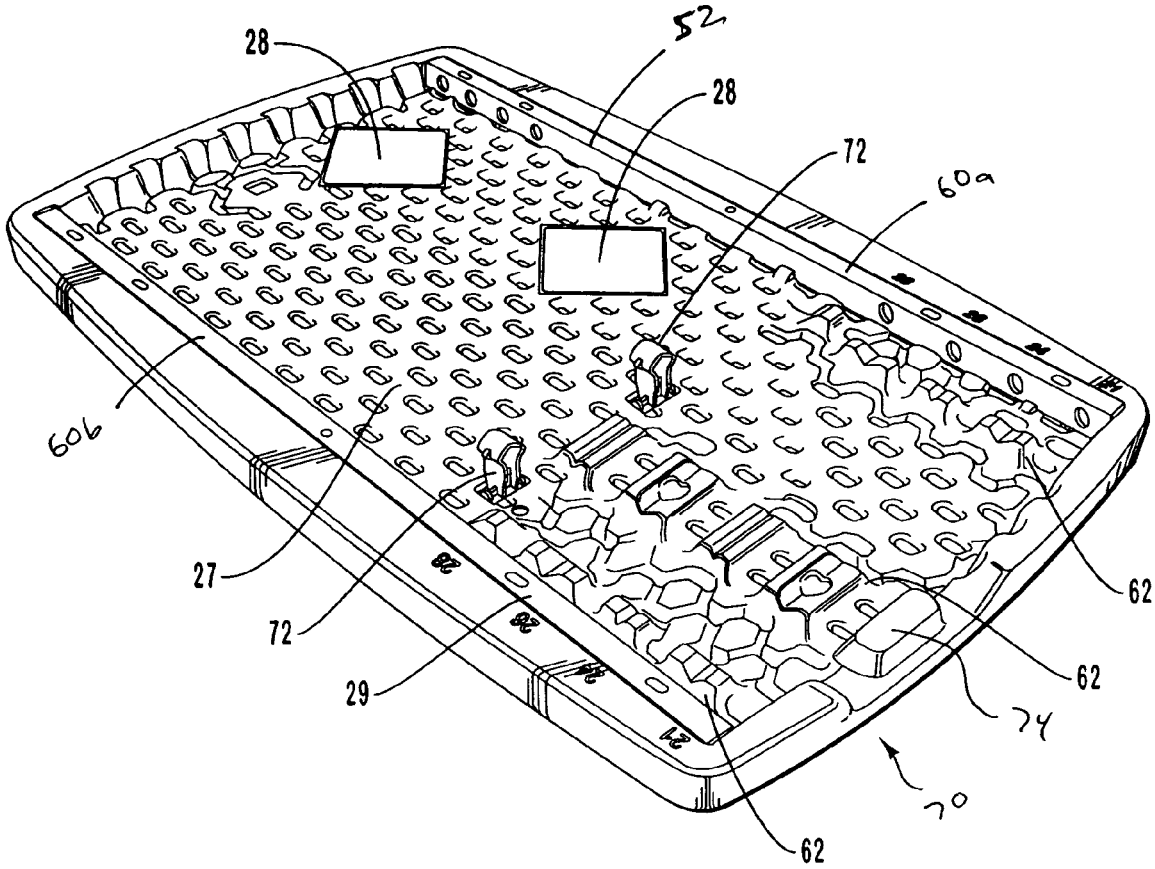
FIG. 3 is a bottom perspective view of a portion of the personal table shown in FIG. 1, illustrating the bottom surface of the table top.
Figure 4:
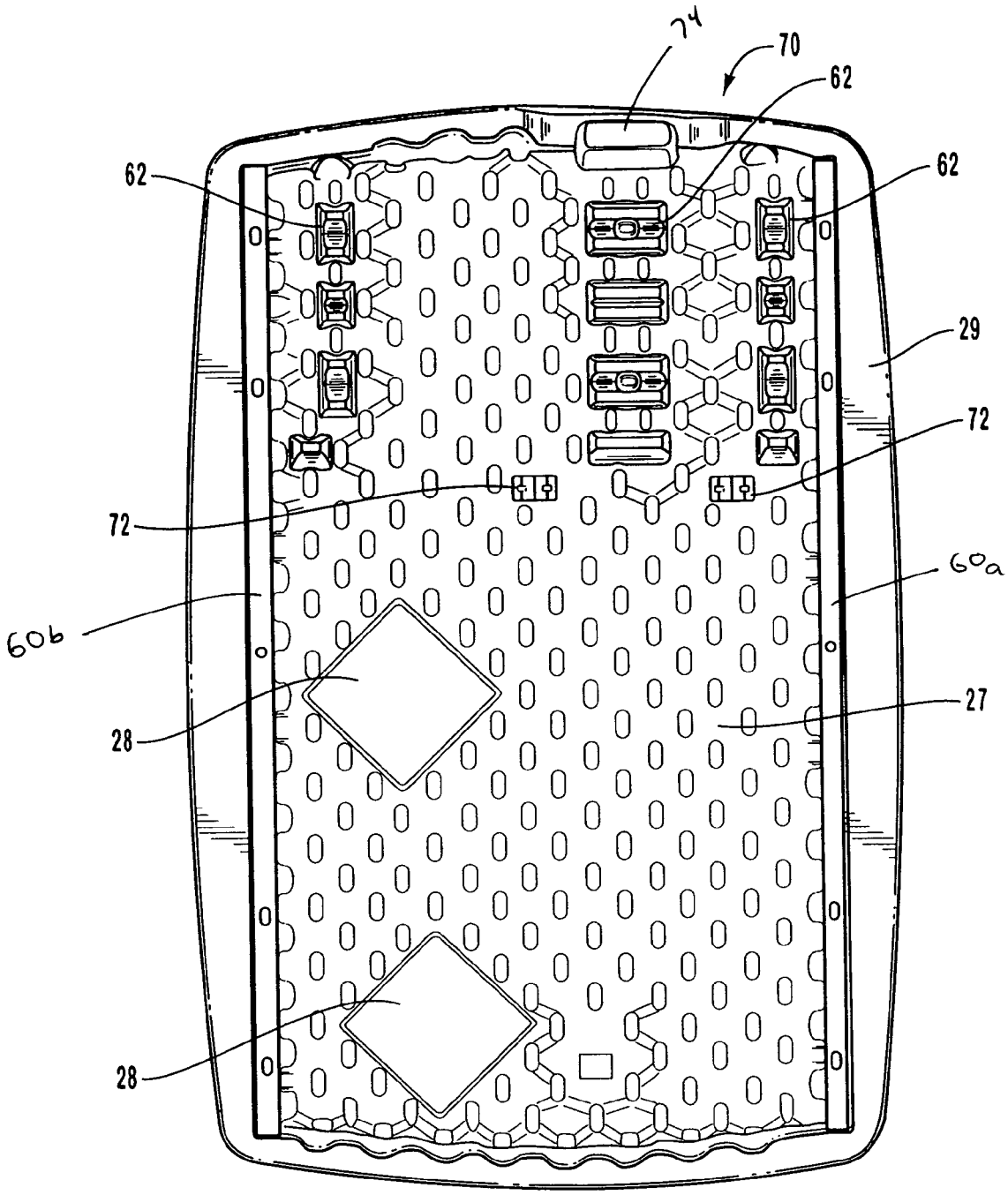
FIG. 4 is a bottom view of the bottom surface of the personal table shown in FIG. 3.

As best seen in FIGS. 3 and 4, the bottom 18 of the table top 12 may include a recessed center section 27. The recessed center portion 27 may cover substantially the entire bottom 18 of the table top 12, or the recessed center portion 27 may cover only a portion of the bottom of the table top. One skilled in the art will appreciate that the table top 12 does not require the recessed center section 27. The table top 12 may include one or more generally planar portions 28 that allow instructions, warnings, safety labels, manufacturer information, operating instructions and other information to be attached to the table top. In addition, the bottom 18 of the table top 12 may include a lip 29. The lip 29 is preferably disposed about the outer edges or perimeter of the table top 12 and the lip is preferably integrally formed with the table top 12 as part of a one-piece structure. For example, the lip 29 could include a hollow interior portion that is formed during the manufacturing process and the hollow interior portion may be in direct communication with a hollow interior portion of the table top 12. The lip 29, however, could also be a separate structure that is attached to the table top 12 and the lip could be disposed inwardly from the outer edges or perimeter of the table top. It will be appreciated that the lip 29 could have other suitable arrangements and configurations, and the table 10 does not require the lip.

As discussed above, the support assembly 14 is used to support the table top 12 above a surface such as the ground or floor. As shown in FIGS. 5–9, an exemplary embodiment of the support assembly 14 includes a first leg 30*a* and a second leg 30*b*. The first leg 30*a* and the second leg 30*b* preferably each include a lower portion 32*a*, 32*b*, a body portion 34*a*, 34*b*, and an upper portion 36*a*, 36*b*, respectively. The lower portion 32*a*, 32*b* of each of the legs 30*a*, 30*b* is preferably sized and configured to contact the ground or floor. Desirably, the lower portion 32*a*, 32*b* is an elongated member that has a length slightly less than the width of the table top 12 to provide a relatively stable base, but the elongated member could be longer or shorter. As shown in the accompanying figures, the lower portions 32*a*, 32*b* are preferably hollow tubes that are lightweight and easy to manufacture, and the tubes are preferably constructed from metal but any suitable materials may be used to construct the lower portions of the legs. End caps 42 may be attached to the ends of the lower portions 32*a*, 32*b* to prevent foreign objects from entering the hollow tubes and the end caps may provide a non-skid and non-marking surface. The end caps 42 may also be sized and configured to assist in moving the table 10, if desired. It will be understood, however, that neither the lower portions 32*a*, 32*b* or end caps 42 are required.

As shown in the accompanying figures, the lower portions 32*a*, 32*b* of the legs 30*a*, 30*b* are preferably positioned generally parallel to each other to provide a stable base for the personal table 10 that resists tipping. It will be appreciated, however, that the lower portions 32*a*, 32*b* could have any desirable size, configuration or design depending, for example, upon the intended use of the personal table 10. For example, the lower portions 32*a*, 32*b* could have a triangular, square, rectangle, generally planar or other suitable shape and configuration, and the support members could have any suitable width and length depending, for example, upon the intended use of the table 10.

The body portions 34*a*, 34*b* of the legs 30*a*, 30*b* preferably consist of one or more elongated members that are used to support the table top 12 above a surface such as the ground or floor. It will be appreciated that the lengths of the body portions 34*a*, 34*b* of the legs 30*a*, 30*b* are preferably the same so that the table top 12 is supported in a generally horizontal position relative to the support surface and the length of the body portions may help determine the overall height of the table 10. The body portions 34*a*, 34*b* of each leg 30*a*, 30*b* are preferably constructed from generally hollow members, such as hollow metal tubes, which are lightweight and easy to manufacture, but the body portions may have any desired sizes and/or configurations. The ends of the body portions 34*a*, 34*b* are preferably securely connected to the lower portions 32*a*, 32*b* of the legs 30*a*, 30*b* by welding or other suitable means.

Figure 5:
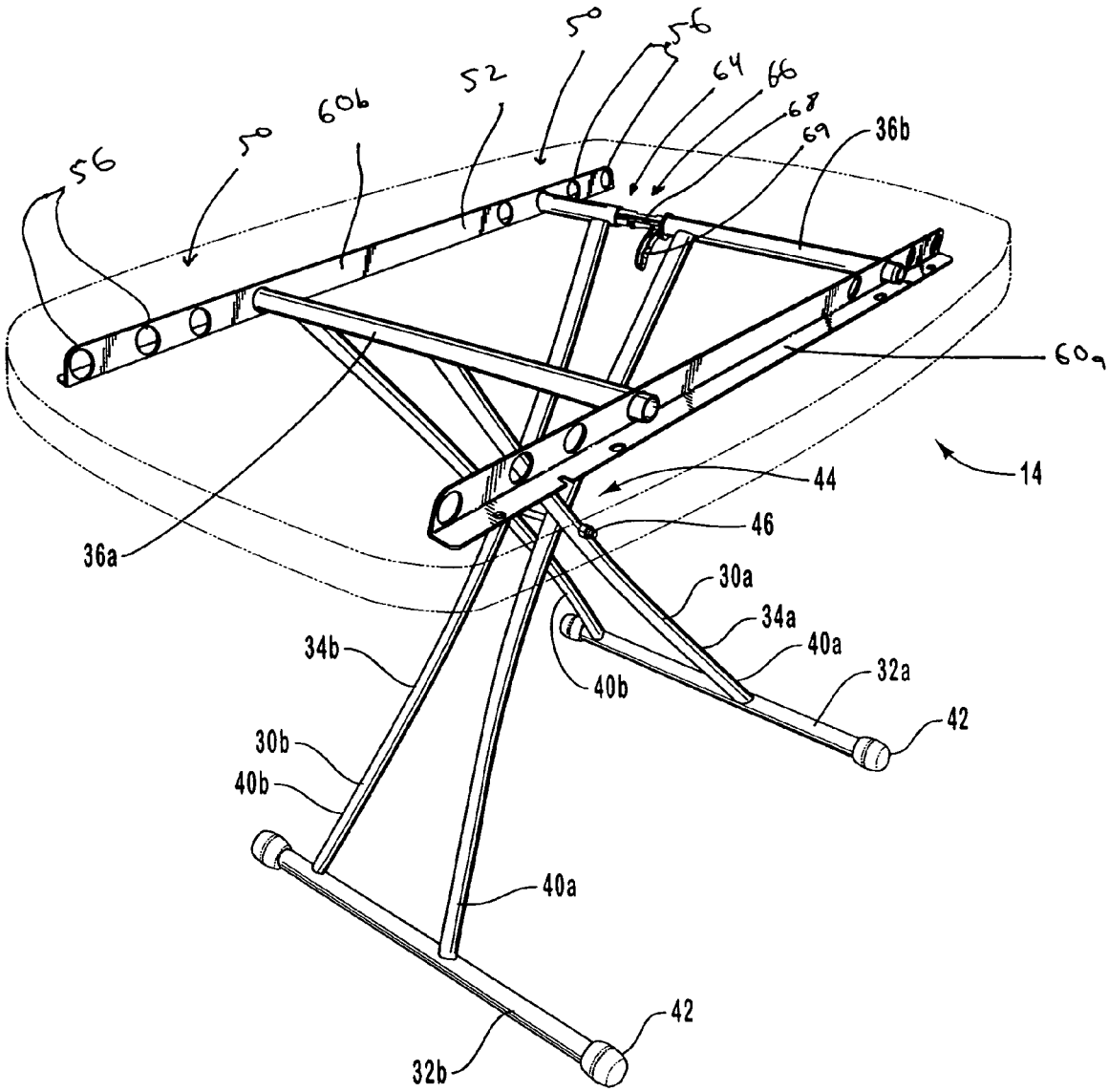
FIG. 5 is a perspective view of a portion of the personal table shown in FIG. 1, illustrating the frame.
Figure 6:
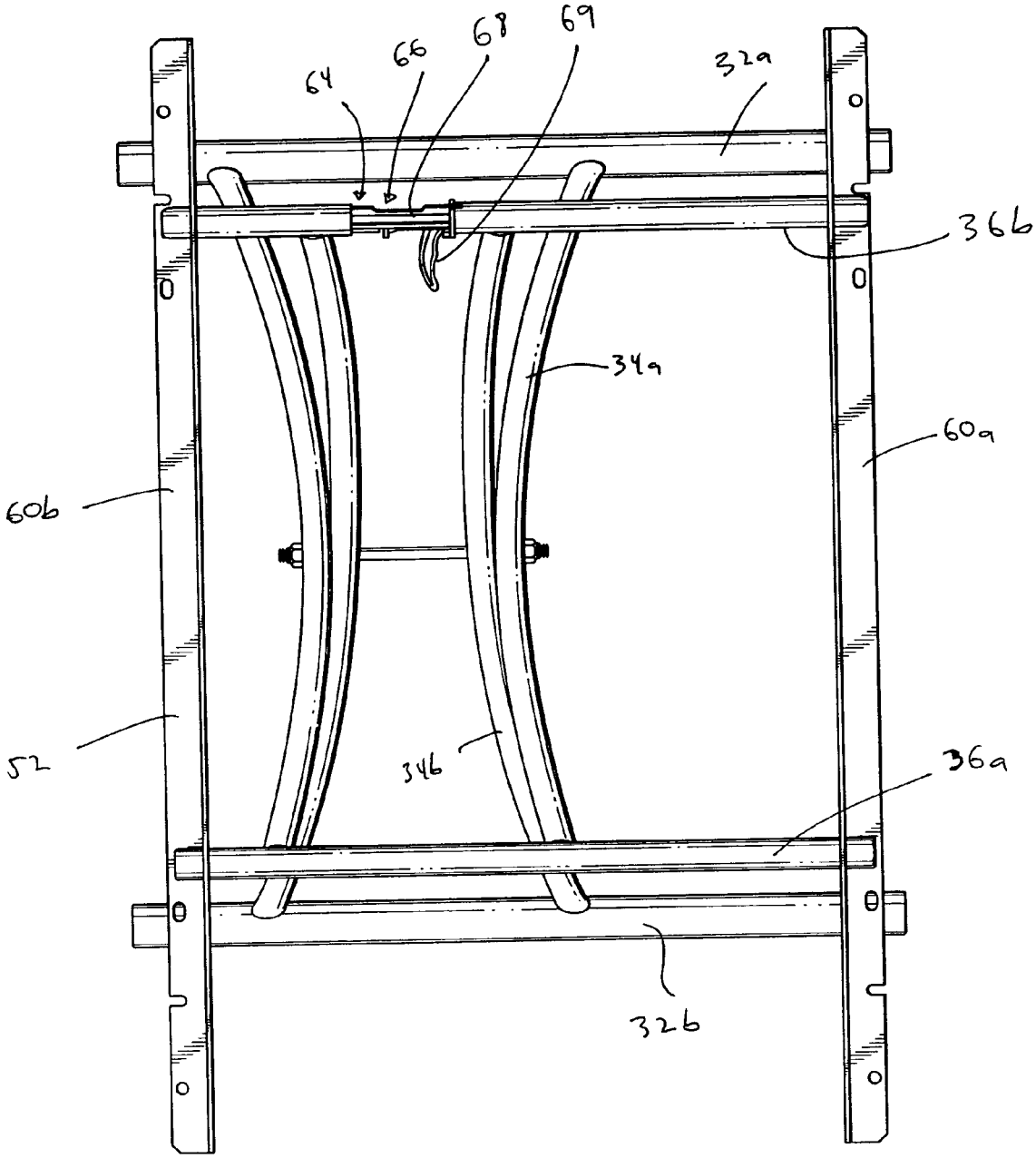
FIG. 6 is a top view of the frame of the personal table shown in FIG. 5.
Figure 8:
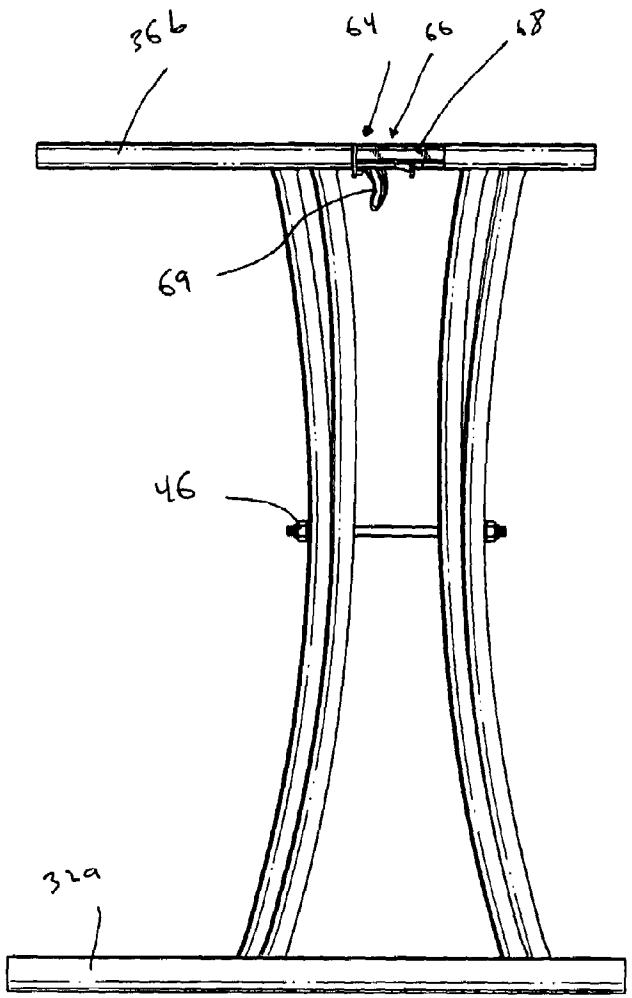
FIG. 8 is a right side view of the frame of the personal table shown in FIG. 5.
Figure 7:
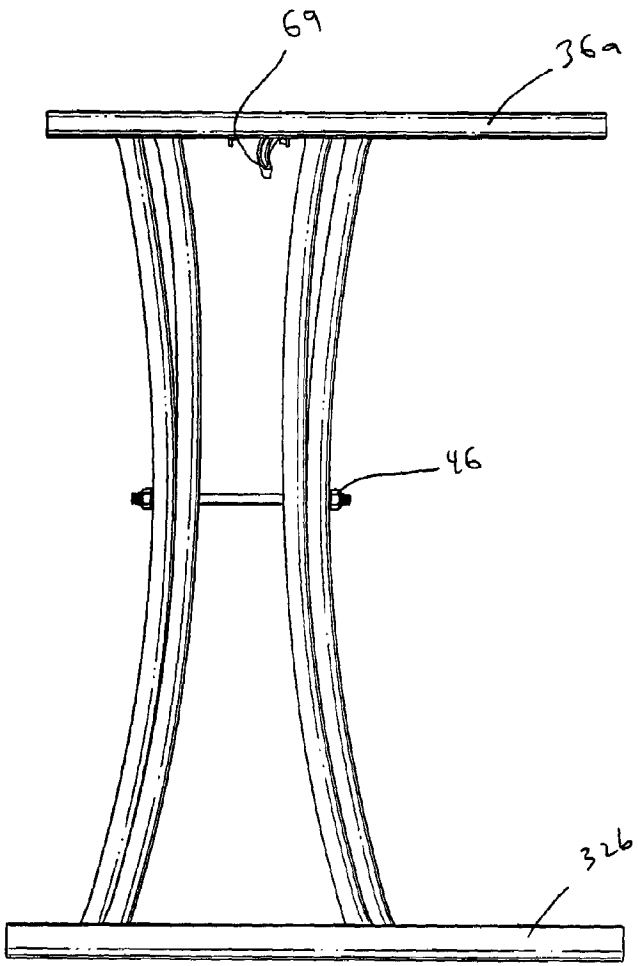
FIG. 7 is a left side view of the frame of the personal table shown in FIG. 5.
Figure 9:
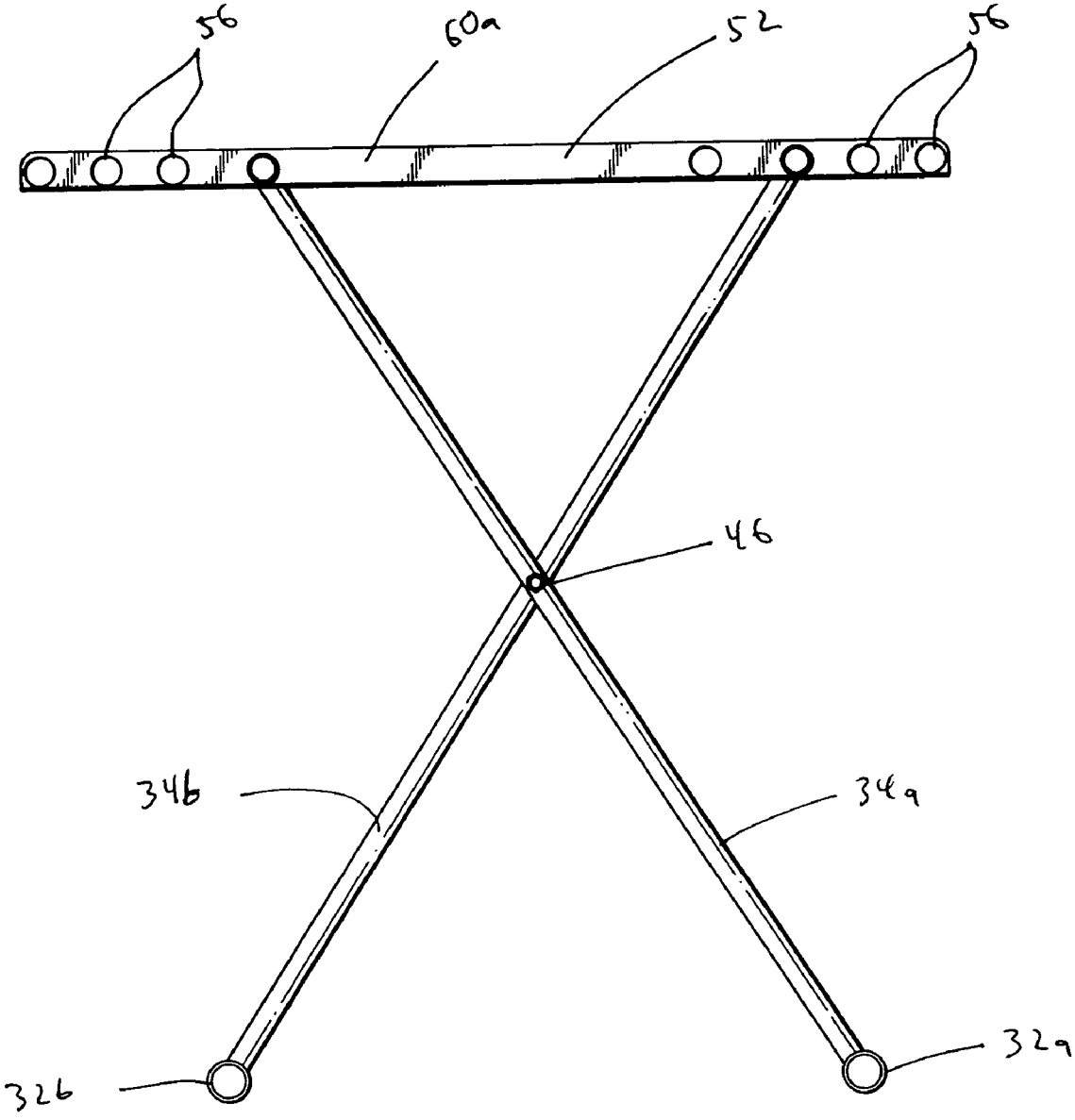
FIG. 9 is a front view of the frame of the personal table shown in FIG. 5.
Figure 10:
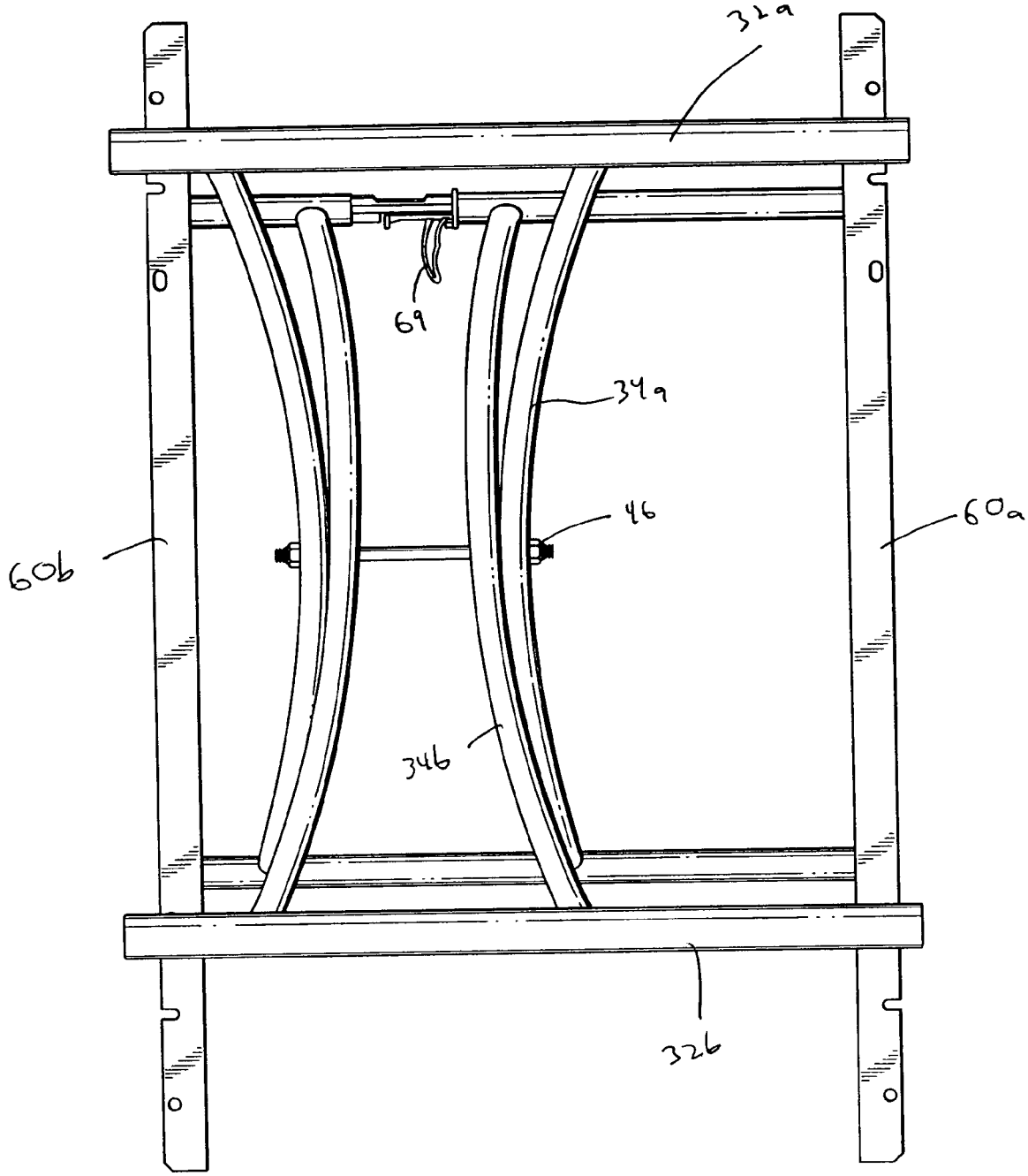
FIG. 10 is a bottom view of the frame of the personal table shown in FIG. 5.

As best seen in FIGS. 5–7, the body portions 34*a*, 34*b* of the legs 30*a*, 30*b* may include two separate elongated support members 40*a*, 40*b*. Advantageously, body portions 34*a*, 34*b* constructed with two separate elongated support members 40*a*, 40*b* may help prevent twisting or torque on the connection of the body portions to the lower portions 32*a*, 32*b* of the legs 30*a*, 30*b*. Additionally, the two separate elongated support members 40*a*, 40*b* of the body portions 34*a*, 34*b* may be curved or spaced apart. In particular, the upper and lower portions of the body portions 34*a*, 34*b* may be spaced apart to facilitate connection of the body portions to the lower portion 32*a*, 32*b*, which may create a more secure connection.

As best seen in FIGS. 5 and 7, the upper and lower portions of the body portions 34*a*, 34*b* are preferably curved outwardly and away from each other. The middle portions of the body portions 34*a*, 34*b* are preferably curved or arched towards each other to allow the body portions to be connected. Desirably, the body portions 34*a*, 34*b* are pivotally connected to allow the legs 30*a*, 30*b* to move relative to each other. The legs 30*a*, 30*b* are connected at a connection point 44 by a connector such as a bolt, pin, screw or other type of suitable fastener 46. Desirably, the legs are curved together towards the connection point 44 to decrease the length of the fastener 46. In addition, the connection point 44 may be disposed closer to the table top 12 than the lower portions 32*a*, 32*b* of the legs 30*a*, 30*b*, but the legs may be connected at any desired point. It will be appreciated that the legs 30*a*, 30*b* may also be slidably or otherwise movably attached. It will also be appreciated that the body portions 34*a*, 34*b* may include only a single elongated support member 40*a*, 40*b*, or more than two elongated support members if desired.

As best seen in FIG. 5, for example, the upper portions 36*a*, 36*b* are attached to the body portions 34*a*, 34*b* of the legs 30*a*, 30*b*. The upper portions 36*a*, 36*b* preferably have generally the same size and size, and the upper portions are desirably constructed from hollow metal tubes. The hollow tubes preferably have a generally circular configuration, but the tubes may also be oval, oblong, square, rectangular or have other suitable configurations. The upper portions 36*a*, 36*b*, however, do not have to be constructed from hollow metal tubes and the upper portions may also be constructed from other suitable components and materials with the appropriate sizes and configurations depending, for example, upon the intended use of the table 10 or the type of connection of the .

The upper portions 36*a*, 36*b* of the legs 30*a*, 30*b* are preferably sized and configured to be received within leg receiving recesses 50. The leg receiving recesses 50 may be disposed within a frame 52 and/or openings 54 formed within the table top 12. The leg receiving recesses 50 preferably have generally the same size and configuration, which allows the upper portions of the legs to be interchangeably attached to the table top 12. This may allow the height of the table 10 to be readily adjusted according to which leg receiving recesses 50 the legs 30*a*, 30*b* are attached. One skilled in the art will appreciate that latches, tabs, locking members, clips, fasteners or other suitable devices may be used to retain the upper portions 36*a*, 36*b* of the legs 30*a*, 30*b* in the leg receiving recesses 50.

The leg receiving recesses 50 may include one or more openings 56 formed in a frame 52. The frame 52 may include two side rails 60*a*, 60*b* that preferably extend at least a majority of the length of the table top 12. The side rails 60*a*, 60*b* are preferably generally parallel disposed and located proximate opposing edges of the table top 12. Advantageously, the side rails 60*a*, 60*b* may be connected to the lip 29 or other suitable portions of the table top 12. The frame 58 is preferably constructed from a relatively sturdy material such as metal and the openings 56 are preferably sized and configured to receive the ends of the upper portions 36*a*, 36*b* of the legs 30*a*, 30*b*.

The leg receiving recesses 50 may also include one or more openings 54 formed in the table top 12. In particular, the openings 54 are preferably formed in an inner surface of the lip 29. The openings 54 may be integrally formed while the table top 12 is being constructed, such as during the blow-molding process, or the openings may be formed after the table top is constructed, such as by drilling, boring or punching. The openings 54 may simply comprise apertures formed in the lip 29 or the openings may comprise recesses, alcoves, indentations, depressions and the like formed in the lip or other suitable portions of the table top 12.

Desirably, the leg receiving recesses 50 include both the openings 56 in the frame 52 and the openings 54 in the table top 12. In particular, the openings 56 in the frame 52 and the openings 54 in the table top 12 are preferably aligned to allow the upper portions 36*a*, 36*b* of the legs 30*a*, 30*b* to be inserted and removed from the leg receiving recesses 50, as desired. It will be appreciated, however, that the leg receiving recesses 50 may also comprise either the openings 56 in the frame 52 or the openings 54 in the table top 12. Whether the upper portions 36*a*, 36*b* of the legs 30*a*, 30*b* are inserted into the openings 56 in the frame 52 and/or the openings 54 in the table top 12, the legs are preferably securely connected to the table top 12 to create a stable and sturdy table 10.

The leg receiving recesses 50 are preferably disposed into at least two pairs of generally aligned recesses disposed proximate opposing sides of the table top 12. In particular, as shown in the accompanying figures, an exemplary embodiment of the table 10 includes four pairs of generally aligned leg receiving recesses 50 disposed near one end of the table top 12. The table 10 may also include one or more leg receiving recesses 50 disposed near the other end of the table top 12. As discussed in greater detail below, one of the legs 30*a*, 30*b* is preferably selectively attached to the leg receiving recesses 50 disposed near one end of the table top 12 and the other leg is preferably securely attached to the leg receiving recesses disposed near the other end of the table top 12. It will be understood, however, that either or both of the legs 30*a*, 30*b* may be securely or selectively attached to the leg receiving recesses 50.

Additionally, the leg receiving recesses 50 can be formed with or without the frame 52. Thus, while the table 10 is preferably constructed with the frame 52, the frame is not required. Additionally, while the frame 52 may be sized and configured to increase the strength and rigidity of the table top 12, the frame may simply be used to help align the upper portions 36*a*, 36*b* of the legs 30*a*, 30*b* with the leg receiving recesses. The frame 52 may also be provided for aesthetic or cosmetic reasons.

The bottom 18 of the table top 12 may include one or more guide members 62 that are preferably sized and configured to help guide the upper portions 36*a*, 36*b* of the legs 30*a*, 30*b* into the leg receiving recesses 50. The guide members 62 may flex or bend slightly to allow the upper portions 36*a*, 36*b* of the legs 30*a*, 30*b* to be inserted and removed from the leg receiving recesses. The guide members 62 may also extend all or a portion of the distance between opposing leg receiving recesses 50 and the guide members may be divided into one or more parts, if desired. For example, as shown in FIGS. 3 and 4, the guide members 62 are divided into three discrete sections and four guide members are used to help align and position the upper portions 36*a*, 36*b* of the legs 30*a*, 30*b* within the four leg receiving recesses 50 disposed towards one end of the table top 12. It will be appreciated that any suitable number and arrangement of guide members 62 may be utilized and that the leg receiving recesses 50 do not require the use of the guide members 62 to guide the upper portions 36*a*, 36*b* of the legs 30*a*, 30*b* into the leg receiving recesses.

The guide members 62 preferably include a hollow interior portion that is formed during the manufacturing process. In addition, the guide members 62 are preferably formed during the manufacturing process as part of an integral, one-piece table top 12. The guide members 62, however, could comprise separate components that are attached to the table top 12. Moreover, the guide members 62 do not have to be formed during the manufacturing process and the guide members can be formed by any suitable means, methods or processes.

Figure 11:
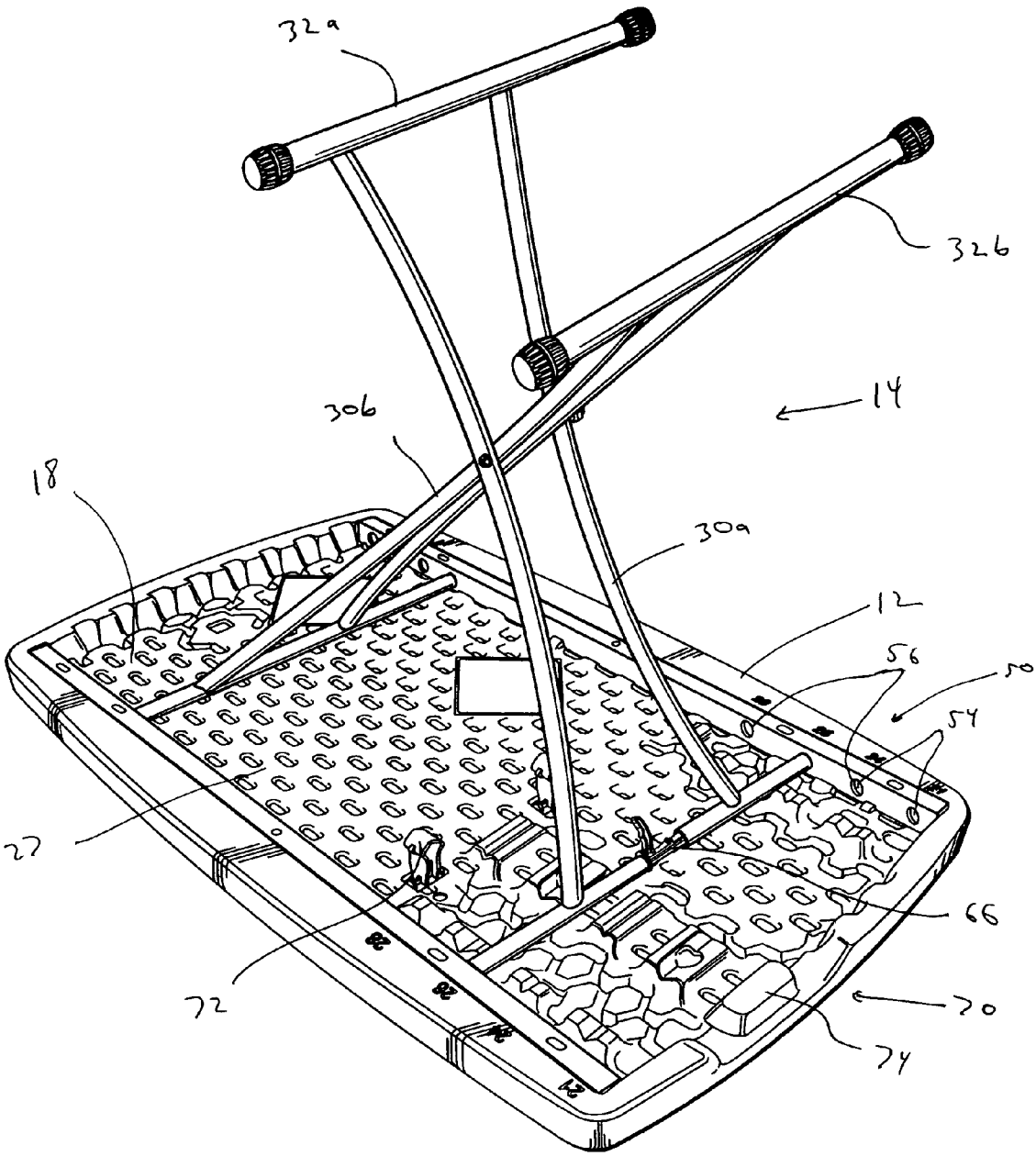
FIG. 11 is a bottom perspective view of the personal table shown in FIG. 1, illustrating the legs in an extended position.
Figure 12:
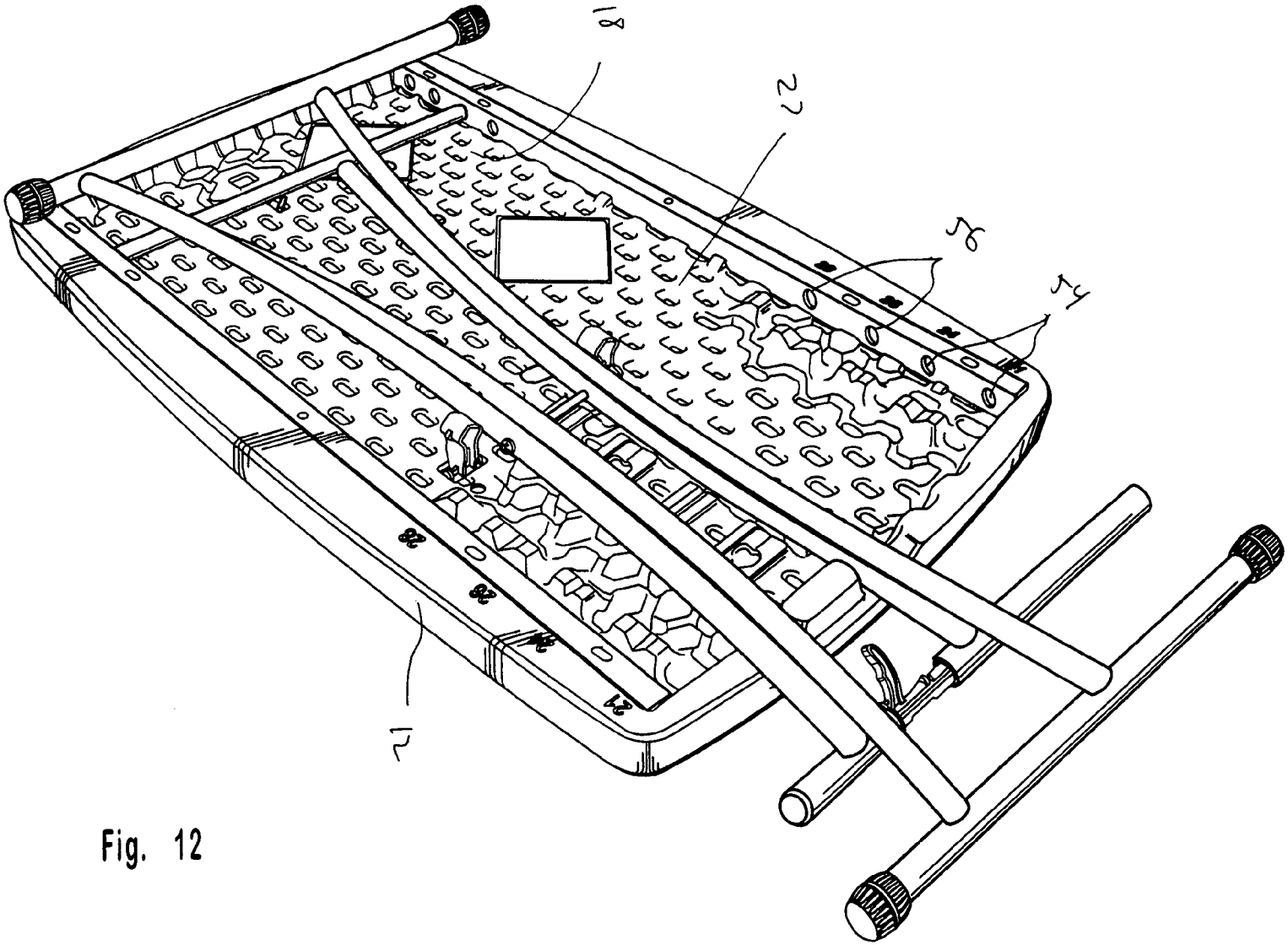
FIG. 12 is a bottom perspective view of the personal table shown in FIG. 1, illustrating the legs in a collapsed position.

The legs 30*a*, 30*b* are desirably sized and configured to be connected to any of the desired plurality of leg receiving recesses 50. In particular, one or both of the legs 30*a*, 30*b* may be sized and configured to be quickly and easily connected and/or disconnected to any desired leg receiving recesses 50. This may allow the legs 30*a*, 30*b*, which are preferably pivotally connected, to pivot or scissor back and forth with respect to one another at a wide variety of angles. This pivotal connection allows the legs 30*a*, 30*b* to be quickly and easily positioned so that the legs can be connected to the desired leg receiving recesses 50 in the table top 12. This pivotal connection also allows the legs 30*a*, 30*b* to be moved between a first or extended position, as shown in FIG. 11, and a second or collapsed position, which is shown in FIG. 12. The legs 30*a*, 30*b* desirably fold generally flat and/or adjacent to each other in the second or collapsed position to allow the table 10 to be easily stored or transported.

In greater detail, one or both of the upper portions 36*a*, 36*b* of the legs 30*a*, 30*b* may be adjustable in length to allow the legs to be selectively connected to the leg receiving recesses 50. For example, the length of the upper portion 36*a*, 36*b* of either or both of the legs 30*a*, 30*b* may be adjustable to allow the legs to be removably inserted into the leg receiving recesses 50. Thus, the length of the upper portion 36*a*, 36*b* of the legs 30*a*, 30*b* may be moved between a first or reduced length position in which the upper portions of the legs may be readily inserted into a desired pair of leg receiving recesses 50 and a second or extended length position in which the legs can be disposed within a desired pair of leg receiving recesses.

As best seen in FIGS. 5–8, the upper portion 36*b* of the leg 30*b* may include an opening 64 and a length adjusting member 66 may be disposed within the opening. The length adjusting member 66 may have an elongated body 68 that is disposed within the opening 64. The length adjusting member 66 desirably allows the length of the upper portion 36*b* of the leg 30*b* to move between the first or reduced length position and the second or extended length position. The length adjusting member 66 is preferably biased to maintain the upper portion 36*b* of the leg 30*b* in the second position. A spring or other resilient member may be used to bias the upper portion 36*b* of the leg 30*b* in the second position. It will be appreciated that other means may be used to bias the upper portion 36*b* of the leg 30*b* into the second position.

A trigger mechanism 69 may be used to assist in adjusting the length of the upper portion 36*b* of the leg 30*b*. For example, a user may grasp the trigger 69 and apply a force on the trigger that overcomes the biasing force of the length adjusting member 66 to allow the length of the upper portion 36*b* of the leg 30*b* to be adjusted. In particular, one end of the length adjusting member 66 may be fastened to one end of the upper portion 36*b* of the leg 30*b* and the other end of the length adjusting member may be freely disposed within the other end of the upper portion of the leg. When a user applies a force to the trigger, the ends of the upper portion 36*b* of the leg 30*b* may be pulled together, which reduces the length of the upper portion, and allows it to be selectively positioned within a desired pair of leg receiving recesses 50. It will be appreciated that the length of the upper portions of the legs may be adjusted by any suitable method or manner. Advantageously, when the upper portions 36*a*, 36*b* of the legs 30*a*, 30*b* are inserted into the leg receiving recesses 50 and the upper portions are in the extended length position, the legs are securely connected to the table top 12.

As shown in the accompanying figures, only the second leg 30*b* is selectively connected to the leg receiving recesses 50 and is adjustable in length. The first leg 30*a* is preferably securely connected to the leg receiving recesses 50 and it not adjustable in length. Thus, the first leg 30*a* is preferably connected to the leg receiving recesses 50 during the manufacturing process and it is generally not removable from the leg receiving recesses. It will be appreciated, however, that the first leg 30*a* may also be selectively connected to the leg receiving recesses, if desired.

An opening 70 may be formed in the bottom 18 of the table top 12 to receive at least a portion of the legs 30*a*, 30*b* in the collapsed position. As seen in FIGS. 1–4, the opening 70 is preferably disposed in the lip 29 and the opening is preferably sized and configured to allow at least a portion of the legs 30*a*, 30*b* to extend through the opening when the legs are in the collapsed position. This allows the legs 30*a*, 30*b* to be disposed generally adjacent to the bottom surface 18 of the table top 12 when the legs are in the collapsed position, which may reduce the required amount of storage space for a table and may facilitate stacking of the tables.

The legs 30*a*, 30*b* may be retained in the collapsed position in the opening 70 by one or more tabs that are located near an edge of the table top 12. The tabs may secure the legs 30*a*, 30*b* in the collapsed position by a friction, snap or interference fit. For example, the tabs may extend over a portion of the opening 70 and the tabs may deform or deflect to allow the legs 30*a*, 30*b* to be received or removed from the opening. The tabs may include a generally hollow interior portion and the tabs may be formed during the manufacturing process as part of an integral, one-piece structure. One skilled in the art will understand that clips, fasteners and other types of devices may be used to secure the legs 30*a*, 30*b* in the collapsed position. For example, as best seen in FIGS. 3 and 4, one or more clips 72 may be used to secure the legs 30*a*, 30*b* in the collapsed position. Desirably, the clips 72 selectively hold the legs 30*a*, 30*b* by a friction, interference or snap fit, but any suitable type of clips, connectors or fasteners may be used to retain the legs in the collapsed position. The legs 30*a*, 30*b*, however, do not have to be held in the collapsed position.

Figure 2:
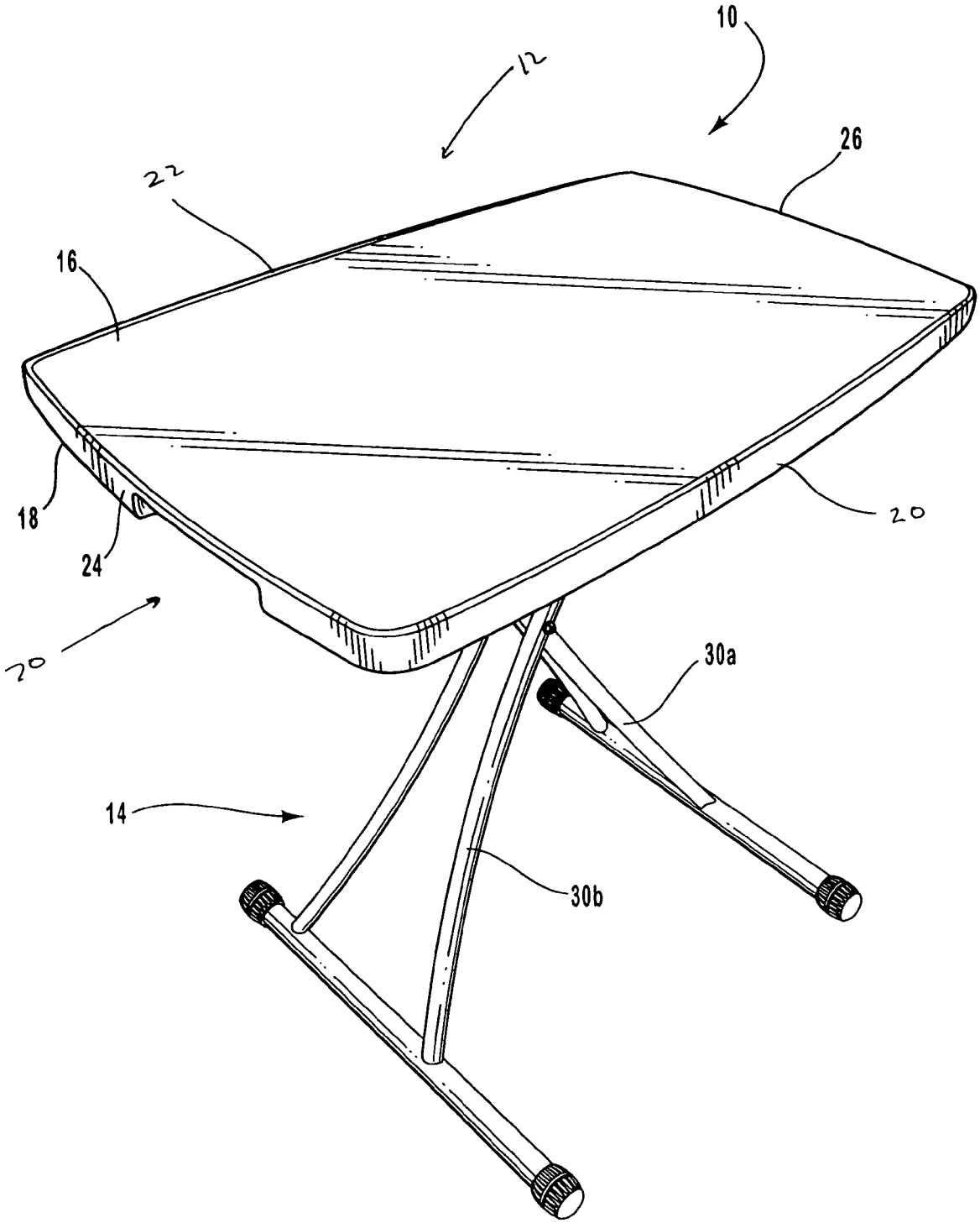
FIG. 2 is a front perspective view of the personal table in accordance with another embodiment of the present invention.

As seen in FIGS. 3 and 4, a center portion 74 may be disposed within the opening 70 and the center portion may be sized and configured to be inserted within a portion of the legs 30*a*, 30*b* when the legs are in the collapsed position. If desired, the center portion 74 may be sized and configured to help secure the legs in the collapsed position. The center portion 74, however, may also be for aesthetic or design reasons. As shown in FIGS. 1 and 2, a center portion 74 does not have to be disposed within the opening 70.

The pivotal connection of the legs 30*a*, 30*b* and the plurality of leg receiving recesses 50 allows the height of the personal table 10 to be easily adjusted. As described in more detail below, the user can select which leg receiving recesses 50 receive either or both of the legs 30*a*, 30*b* and this allows the desired height to be selected. For example, it will be appreciated that if the legs 30*a*, 30*b* are attached to two leg receiving recesses 50 that are close together, the table 10 will have a given height. However, if the legs 30*a*, 30*b* are attached to two leg receiving recesses 50 that are farther apart, then the table 10 will have a lower height.

Additionally, the legs 30*a*, 30*b* can desirably be quickly and easily moved between the extended and collapsed positions. For example, if the support legs 30*a*, 30*b* are completely disengaged from table top 12, then the legs 30*a*, 30*b* can be folded into the collapsed position for storage. Alternatively, one or more of the legs 30*a*, 30*b* may be attached to the table top 12 when the legs in the collapsed position. Thus, a variety of different configurations are contemplated when table 10 is collapsed, including: (1) the support assembly 14 is completely disengaged from table top 12; (2) at least a portion of support assembly is connected to the table top while another portion of the support assembly is disconnected from the table top; and (3) at least a portion of support assembly is permanently coupled to table top.

The support assembly 14 is preferably configured to maximize the legroom for the user when table 10 is in an upright position. For example, as shown in FIGS. 1–2, the body portions 34*a*, 34*b* are not centered with the lower portions 32*a*, 32*b* or upper portions 36*a*, 36*b* of legs 30*a*, 30*b*. Instead, the body portions 34*a*, 34*b* are disposed towards an end of the lower portions 32*a*, 32*b* and upper portions 36*a*, 36 of legs 30*a*, 30*b*. Thus, when the table top 12 is coupled to the support assembly 14, as shown in FIG. 1 for example, the body portions 34*a*, 34*b* are located proximate the rear 22 of the table top 12. Therefore, when the user is seated at front 20 of table 10, the body portions 34*a*, 34*b* of the legs 30*a*, 30*b* are positioned farther away from the user so as to avoid impeding the user's space.

In particular, because the body portions 34*a*, 34*b* of the legs 30*a*, 30*b* are positioned near the rear 22 of table top 12, the user can slide the table 10 closer to their body. This allows the user to position the table top 12 in a desired position while still maintaining adequate legroom underneath the table 10. Thus, it can be seen that table 10 facilitates the ergonomic comfort of the user by reducing the need of the user to lean forward over the table in order to perform a particular task, such as reading or crafting. The offset body portions 34*a*, 34*b* also allow the user to slide a chair under the table 10 such that the support assembly 14 does not generally interfere with the chair. It will be appreciated, however, that the body portions 34*a*, 34*b* may be located in any suitable relation to the lower portions 32*a*, 32*b* and/or upper portions 36*a*, 36*b* of the legs 30*a*, 30*b*.

As seen in FIGS. 3 and 4, for example, a plurality of depressions 76 may be formed in the bottom 18 of the table top 12. The depressions 76 are preferably sized and configured to provide additional structural support and integrity to table top 12. The depressions 76 may cover a substantial portion of the bottom 18 of the table top 12 or the depressions may cover only a portion of the bottom of table top. The depressions 76 may also be located in the lip 29, guide members 62 and/or opening 70, if desired. Alternatively, the table top 12 can be constructed without any depressions 76. In addition, while the depressions 76 are preferably located in the bottom 18, it will be appreciated that depressions may also be formed in any desired portion of the table top 12.

As shown in FIGS. 3 and 4, the depressions 76 may be formed in an array. The depressions 76 in the array may be located in a staggered, geometric, random or other suitable pattern. Additionally, the depressions 76 may extend from one surface to an opposing surface such that an end of the depression contacts or engages the opposing surface. The depressions 76 may also extend only a portion of the distance between the opposing surfaces. For example, the depressions 76 may extend from the bottom 18 to the top 16, but the depressions may also extend only a portion of the distance between the bottom and top portions of the table top 12.

The depressions 76 may be designed to increase the strength and structural integrity of the table 12. While it was previously believed that stronger structures were provided by making the walls thicker and/or adding structures such as ribbing, the depressions 76 may provide the surprising and unexpected result that an increased number of depressions may provide a stronger structure and/or thinner walls may be used to construct the structure. Surprisingly, the depressions 76 may increase the structural integrity of the structure despite forming disruptions in the continuity of bottom portion 18 of the table top 12, and less plastic can be used to make the structure even though the plurality of depressions are formed in the structure. The costs of manufacturing and transportation may be decreased because thinner plastic walls may be used to construct the table top 12, which may create a lighter weight table 10.

Additionally, when blow-molded structures are formed, a certain amount of time must elapse before the structure can be removed from the mold. Blow-molded structures with thicker walls require a longer cooling time than structures with thinner walls. The depressions 76, however, may allow table tops with thinner plastic walls to be constructed and that reduces the cooling time before the structure can be removed from the mold. Significantly, a reduced cycle time may increase the efficiency of manufacturing process. In addition, because less plastic is required, the cost of the table 10 may be reduced.

The leg receiving recesses 50, openings 54, guide members 62, opening 70 and/or depressions 76 may be formed integrally with table top 12 during the manufacturing process as part of a one-piece structure. For example, one or more of these features may be formed during a blow-molding process. Advantageously, this allows a strong, lightweight structure to be created. It will be appreciated, however, that these features do not have to be formed as part of a unitary structure and these features can be formed separately or after the manufacturing process.

As best seen in FIG. 11, the first leg 30*a* is preferably selectively connected to any suitable receiving recess 50 disposed near the one side of the table top 12 and the second leg 30*b* is preferably securely connected to the table top in a generally fixed position. Because the first leg 30*a* is selectively connected to any suitable receiving recess 50, the height of the table 10 to be adjusted. For example, if the first leg 30*a* is connected to the receiving recess 50 disposed proximate the center of the table top 12, then the table 10 will have a first height such as twenty-eight inches. On the other hand, if the first leg 30*a* is connected to the receiving recess 50 disposed proximate the right side 24, then the table 10 will have a second height such as twenty-one inches. Of course, the first leg 30*a* could also be connected to one of the other receiving recesses 50 to create a table 10 with a height such as twenty-four or twenty-six inches. It will be appreciated that the table 10 could be sized and configured to have any suitable height and the table may include any desired number of receiving recesses 50 to allow the height of the table to be adjusted. While the first leg 30*a* is preferably selectively connected to the table top 12 and the second leg 30*b* is preferably securely connected to the table top 12, it will be appreciated that the second leg may be selectively connected to the table top and the first leg may be securely connected to the table top. It will also be appreciated that the first and second legs 30*a*, 30*b* may be selectively secured to the table top 12 if desired.

In order to use the table 10 shown in FIGS. 11 and 12, the second leg 30*b* is securely connected to the table top 12 and the first leg 30*a* is selectively connected to the table top. In particular, the first leg 30*a* is selectively connected to any of the desired leg receiving recesses 50 according to the desired height of the table. In order to adjust the height of the personal table 10, the first leg 30*a* may be removed from its leg receiving recesses 50 and inserted into another desired leg receiving recess. In order to collapse the table 10, the first leg 30*a* is removed from its leg receiving recess 50 and the legs 30*a*, 30*b* are positioned in the collapsed position shown in FIG. 12. Advantageously, the legs 30*a*, 30*b* may extend through the opening 70 and the clips 72 may retain the legs in the collapsed position. When it is desired to use the table 10, the legs 30*a*, 30*b* are removed from the opening 70 and the first leg 30*a* is inserted into the desired leg receiving recesses 50. It will be appreciated that the entire support assembly 14 can be removed if both legs 30*a*, 30*b* are both selectively attached to the table top 12.

It will be appreciated that the leg receiving recesses 50 may also be disposed along the width of table top 12. That is, the leg receiving recesses 50 may be disposed proximate the right and left sides 24, 26 of the table top 12. Advantageously, this may provide additional uses for the personal table 10. Further, if desired, the leg receiving recesses 50 may be disposed along the length and/or width of the table top 12 depending, for example, upon the intended use of the table 10.

From the foregoing description, the leg receiving recesses 50 allow the personal table 10 to be readily adjusted to various suitable heights. For example, the personal table 10 may be configured to have a maximum height, an intermediate height, and a minimum height. Thus, the table 10 may be configured to have a height that enables a user to stand and utilize the table, a height that is generally equal to the height of a counter top, and/or a height that enables the user to be seated at the table. Additionally, the height of the table 10 may be adjusted according to the desired use of the table. For example, the height of the table may be adjusted to allow the table to be used by children, or the table may have a height which allows it to be used as a television tray or table. Significantly, the various heights of table 10 can be predetermined and designed for any suitable purpose. This provides great flexibility and a wide variety of uses for table 10.

Significantly, the various heights of the table can be predetermined and designed for any suitable purpose. This provides great flexible and a wide variety of uses for the table. Further, the legs can be connected to the table top by any suitable type of support structure.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A personal table comprising;

a table top constructed from plastic, the table top including an upper surface and a lower surface that is spaced apart from the upper surface;

at least two pairs of leg receiving recesses disposed on the underside of the table top;

a first leg including a body portion and an upper portion, the upper portion of the first leg being sized and configured to be selectively received and retained within one of the pairs of leg receiving recesses; and a second leg including a body portion and an upper portion, the upper portion of the second leg being sized and configured to be selectively received and retained within another of the pairs of leg receiving recesses, the first leg and second leg being pivotally interconnected to form a generally X-shaped configuration;

wherein a length of the upper portion of the first leg is adjustable between a first position in which the first leg can be inserted into a desired pair of leg receiving recesses and a second position in which the first leg can be secured within a desired pair of lea receiving recesses.

2. The personal table as in claim 1, wherein the upper portion of the first leg can be selectively removed from one of the leg receiving recesses and received within another of the leg receiving recesses to allow a height of the personal table to be adjusted.

3. The personal table as in claim 1, further comprising a plurality of depressions integrally formed in the lower surface of the table top as part of a unitary one-piece construction, the depressions extending from the lower surface of the table top towards the upper surface of the table top.

4. The personal table as in claim 3, further comprising an end for each of the plurality of depressions, the end being sized and configured to contact the upper surface of the table top.

5. The personal table as in claim 1, further comprising a opening integrally formed in a generally downwardly lip formed in the table top, the opening being sized and configured to receive at least a portion of the first leg and the second leg when the first leg and second leg, are in a collapsed position.

6. The personal table as in claim 1, wherein the body portion of the first leg and the body portion of the second leg are offset towards an edge of the table top when the first leg and the second leg are attached to the table top.

7. The personal table as in claim 1, further comprising a first lower portion connected to the first leg and a second lower portion connected to the second leg, the first lower portion and the second lower portion having a length that is less than a width of the table top.

8. A personal table comprising:

a table top constructed from plastic, the table top including a lower surface and an upper surface;

a first pair of leg receiving recesses, a second pair of leg receiving recesses and a third pair of leg receiving recesses disposed on the underside of the table top;

a first leg, including an upper portion that is sized and configured to be connected to the first pair of leg receiving recess;

a second leg including an upper portion that is adjustable in length between an extended position and a collapsed position;

wherein the second leg can be disconnected from the second pair of leg receiving recesses when the upper portion of the second leg is in the collapsed position and selectively connected to the third pair of leg receiving recesses when the upper portion of the second leg is in the extended position to change a height of the personal table.

9. The personal table as in claim 8, wherein the first leg and the second leg are pivotally connected in a generally X-shaped configuration.

10. The personal table as in claim 8, further comprising an opening formed in a side wall of the table top; and further comprising a first position in which the first leg and the second leg extend generally away from the table top and a second position in which the first leg and the second leg are positioned generally proximate the table top; at least a portion of the first leg and at least a portion of the second leg being disposed within the opening in the side wall when the legs are in the second position.

11. The personal table as in claim 8, further comprising a trigger mechanism attached to the upper portion of the second leg, the trigger mechanism being sized and configured to assist in moving the upper portion of the second leg between the extended position and the collapsed position.

12. The personal table as in claim 11, further comprising one or clips attached to a lower portion of the table top, the clips being sized and configured to retain the first leg and the second leg in a collapsed position.

13. A personal table comprising:

a table top constructed from blow-molded plastic, the table top including a generally hollow interior portion formed during the blow molding process, a lower surface, and an upper surface that is spaced apart from the lower surface;

a frame connected to the lower surface of the table top, the frame including a plurality of pairs of leg receiving recesses;

a single support assembly that is sized and configured to be selectively connected to the leg receiving recesses of the frame, the support assembly including a first leg and a second leg that are pivotally connected, the first leg and second leg being movable between a first position in which the first leg and the second leg have a generally X-shaped configuration and a second position in which the first leg and the second leg are in a collapsed configuration.

14. The personal table as in claim 13, further comprising at least two pairs of leg receiving recesses formed in the table top, the first leg including an upper portion that is sized and configured to be selectively received within one of the pairs of leg receiving recesses in the frame and the table top, and the second leg including an upper portion that is sized and configured to be selectively received within another of the pairs of the leg receiving recesses in the frame and the table top.

15. The personal table as in claim 13, wherein the first leg can be selectively removed from one of the pairs of leg receiving recesses and received within another of the pairs of leg receiving recesses to allow a height of the personal table to be adjusted.

16. The personal table as in claim 13, wherein the length of the upper portion of the first leg is adjustable in length between a first position in which the first leg can be inserted into a desired pair of leg receiving recesses and a second position in which the first leg can be secured within a desired pair of leg receiving recesses.

17. The personal table as in claim 13, further comprising a plurality of depressions integrally formed in the lower surface of the table top as part of a one-piece construction, the depressions extending from the lower surface of the table top towards the upper surface of the table top.

18. The personal table as in claim 17, further comprising an end for each of the plurality of depressions, the end being sized and configured to contact the upper surface of the table top.

19. The personal table as in claim 13, further comprising a opening integrally formed in a generally downwardly lip formed in the table top, the opening being sized and configured to receive at least a portion of the first leg and the second leg when the first leg and second leg are in a collapsed position.

20. The personal table as in claim 13, wherein the first leg includes an elongated body portion and the second leg includes an elongated body portion, the elongated body portion of the first leg and the elongated body portion of the second leg being offset towards an edge of the table top when the first leg and the second leg are attached to the table top.

21. The personal table as in claim 13, further comprising at least one guide member formed in the lower surface of the table top, the guide member being sized and configured to assist in connecting the support assembly to the table top.

22. The personal table as in claim 13, wherein an upper portion of the first leg can be selectively removed from one of the pairs of leg receiving recesses and received within another of the pairs of leg receiving recesses to allow a height of the personal table to be adjusted.

23. The personal table as in claim 13, wherein the length of an upper portion of the first leg is adjustable in length between a first position in which the first leg can be inserted into a desired pair of leg receiving recesses and a second position in which the first leg can be secured within a desired pair of leg receiving recesses.

24. The personal table as in claim 13, wherein the first leg of the single support assembly includes a body portion with one or more elongated support members; and wherein the second leg includes a body portion with one or more elongated support members.

25. The personal table as in claim 24, wherein the pair of legs of the single leg assembly includes a first leg with a body portion having one or more elongated members and a second leg with a body portion having one or more elongated members.

26. A personal table that is intended to be used by a single user and the height of the personal table is capable of being adjusted, the personal table comprising:

a table top constructed from plastic, the table top including an upper surface and a lower surface;

a plurality of leg receiving recesses integrally formed in the table top as part of a one-piece construction; and a single support assembly that is sized and configured to support the table top above a surface, the support assembly comprising:

a first leg including an upper portion and a body portion; and a second leg that is pivotally connected to the first leg, the second leg including an upper portion and a body portion;

wherein the upper portion of the first leg is sized and configured to be connected to one of the leg receiving recesses and the upper portion of the second leg is sized and configured to be connected to another of the leg receiving recesses; and wherein the upper portion of the first leg is capable of being disconnected from one of the leg receiving recesses and connected to another of the leg receiving recesses in order to change the height of the table.

27. A personal table that is sized and configured to be used by a single person and the table being adjustable in height relative to a support surface, the personal table comprising:

a plastic table top including an upper surface, a lower surface spaced apart from the upper surface, and a side wall;

a single leg assembly. that is selectively connected to the table top, the single leg assembly including legs that are pivotally connected in a generally X-shaped configuration, the legs being selectively movable between an extended position and a collapsed position; and a plurality of receiving members integrally formed in the table top as part of a unitary, one-piece structure, the receiving members being sized and configured to interchangeably receive and retain a portion of the leg assembly in a generally fixed position relative to the table top to allow the height of the personal table to be adjusted.

28. The personal table as in claim 27, further comprising an opening in the side wall of the table top, the opening being sized and configured to allow at least a portion of the leg assembly to extend through the opening when the legs are in the collapsed position.

29. The personal table as in claim 28, wherein the opening allows the legs to be generally positioned parallel and adjacent to the lower surface of the table top when the legs are in the collapsed position.

30. The personal table as in claim 28, wherein the opening is sized and configured to receive and retain the legs in a snap fit configuration when the legs are in the collapsed position.

31. The personal table as in claim 28, wherein the opening is sized and configured to facilitate stacking of the table by allowing the legs to be positioned generally parallel and adjacent to the lower surface of the table top when the legs are in the collapsed position.

32. The personal table as in claim 27, wherein both of the legs are selectively connected to the table top to allow the height of the table to be adjusted.

33. A personal table that is sized and configured to be used by a single person and the table being adjustable in height relative to a support surface, the personal table comprising:

a plastic table top including an upper surface, a lower surface that is spaced apart from the upper surface, and a side wall;

a single leg assembly that is selectively connected to the table top, the leg assembly including legs that are pivotally connected in a generally X-shaped configuration; the legs being selectively movable between an extended position and a collapsed position; and an opening in the side wall of the table top that is sized and configured to allow at least a portion of the leg assembly to extend through the opening when the legs are in the collapsed position.

34. The personal table as in claim 33, wherein the opening allows the legs to be disposed generally parallel and adjacent to the lower surface of the table top when the legs are in the collapsed position.

35. The personal table as in claim 33, wherein the opening is sized and configured to facilitate stacking of the table by allowing the legs to be positioned generally parallel and adjacent to the lower surface of the table top when the legs are in the collapsed position.

36. The personal table as in claim 33, further comprising a plurality of receiving members integrally formed in the table top as part of a unitary, one-piece structure, the receiving members being sized and configured to selectively receive and retain at least a portion of the leg assembly in a generally fixed position relative to the table top.

37. The personal table as in claim 33, wherein both of the legs are selectively connected to the table top to allow the height of the table to be adjusted.

38. A personal table that is sized and configured to be used by a single person, the table being adjustable in height relative to a support surface, the personal table comprising:

a plastic table top including an upper surface, a lower surface that is spaced apart from the upper surface, a side wall, and a hollow interior portion;

a single leg assembly that is selectively connected to the table top, the leg assembly including a pair of legs that are pivotally connected in a generally X-shaped configuration; the legs being selectively movable between an extended position and a collapsed position; and a plurality of receiving members integrally formed in the table top as part of a unitary, one-piece structure, the receiving members being sized and configured to interchangeably receive and retain at least a portion of the leg assembly in a generally fixed position relative to the table top.

39. The personal table as in claim 26, wherein the body portion of the first leg of the single support assembly includes one or more elongated support members; and wherein the body portion of the second leg includes one or more elongated support members.

* * * * *

UNITED STATES PATENT AND TRADEMARK OFFICE

CERTIFICATE OF CORRECTION

PATENT NO. : 7,059,254 B2
APPLICATION NO. : 10/692892
DATED : June 13, 2006
INVENTOR(S) : Strong et al.

It is certified that error appears in the above-identified patent and that said Letters Patent is hereby corrected as shown below:

Column 1
Line 11, after "PERSONAL TABLE", insert --, now U.S. Pat. No. 6,912,961--
Lines 16-17, remove "now U.S. Pat. No. 6,912,961 TOP,"

Signed and Sealed this

Twentieth Day of March, 2007

JON W. DUDAS
*Director of the United States Patent and Trademark Office*

UNITED STATES PATENT AND TRADEMARK OFFICE

CERTIFICATE OF CORRECTION

PATENT NO. : 7,059,254 B2
APPLICATION NO. : 10/692892
DATED : June 13, 2006
INVENTOR(S) : L. Curtis Strong et al.

It is certified that error appears in the above-identified patent and that said Letters Patent is hereby corrected as shown below:

Title Page 1
after "Related U.S. Application Data" insert
--(63) Continuation-in-part of application No. 10/340,018, filed on Jan. 9, 2003, now Pat. No. 6,912,961, and a continuation-in-part of application No. 29/176,792, filed on Feb. 26, 2003, now Pat. No. Des. 485,100, and a continuation-in-part of application No. 29/176,842, filed on Feb. 26, 2003, now Pat. No. Des. 485,719, and a continuation-in-part of application No. 29/176,841, filed on Feb. 26, 2003, now Pat. No. Des. 481,567.--

Column 1
Lines 8-9 remove ", now U.S. Pat. No. 6,912,961 entitled PERSONAL TABLE"

Signed and Sealed this

Thirty-first Day of August, 2010

David J. Kappos

David J. Kappos
*Director of the United States Patent and Trademark Office*